US010058132B2

(12) United States Patent
Harris et al.

(10) Patent No.: US 10,058,132 B2
(45) Date of Patent: Aug. 28, 2018

(54) CLEAVAGE ENHANCING UNDERGARMENT SYSTEM

(71) Applicant: MISSES KISSES, LLC, Los Angeles, CA (US)

(72) Inventors: Amanda M. Harris, Los Angeles, CA (US); Alistair D. Black, Los Gatos, CA (US); Jean-Pierre Durrand, Glendale, CA (US)

(73) Assignee: MISSES KISSES, LLC, Los Angeles, CA (US)

( * ) Notice: Subject to any disclaimer, the term of this patent is extended or adjusted under 35 U.S.C. 154(b) by 0 days.

(21) Appl. No.: 15/543,776

(22) PCT Filed: Mar. 7, 2017

(86) PCT No.: PCT/US2017/021028

§ 371 (c)(1),
(2) Date: Jul. 14, 2017

(87) PCT Pub. No.: WO2017/204882

PCT Pub. Date: Nov. 30, 2017

(65) Prior Publication Data

US 2018/0213853 A1 Aug. 2, 2018

Related U.S. Application Data

(60) Provisional application No. 62/340,338, filed on May 23, 2016.

(51) Int. Cl.

| | |
|---|---|
| ***A41C 3/10*** | (2006.01) |
| ***A41C 3/12*** | (2006.01) |
| ***A41C 3/06*** | (2006.01) |

(52) U.S. Cl.

CPC ..... *A41C 3/10* (2013.01); *A41C 3/06* (2013.01); *A41C 3/124* (2013.01); *A41D 2400/38* (2013.01)

(58) Field of Classification Search

CPC .... A41C 3/00; A41C 3/06; A41C 3/10; A41C 3/12; A41C 3/14; A41C 3/0007; A41C 3/065; A41C 3/124; A41C 3/128; A41C 3/144

USPC ..... 450/41, 45, 46, 48, 53

See application file for complete search history.

(56) References Cited

U.S. PATENT DOCUMENTS

| | | | | |
|---|---|---|---|---|
| 2,391,417 A | | 12/1945 | Hill | |
| 2,414,590 A | | 1/1947 | Folb | |
| 2,608,689 A | * | 9/1952 | Leuven, Jr. ..... | A41C 3/124 450/45 |
| 2,844,151 A | | 7/1958 | Lemons | |
| 2,900,981 A | | 8/1959 | Harbener | |

(Continued)

OTHER PUBLICATIONS

PCT/US2017/021028—dated Mar. 7, 2017—International Search Report & Written Opinion dated May 26, 2017.

(Continued)

*Primary Examiner* — Gloria Hale
(74) *Attorney, Agent, or Firm* — Karish & Bjorgum, PC

(57) ABSTRACT

A braette including compression pads having inner surfaces contoured to engage the outer surface of the breasts of a wearer which are interconnected by a force generating member to apply a force to the breasts of the wearer to push them toward each other and to thereby enhance the cleavage.

11 Claims, 5 Drawing Sheets

(56) References Cited

U.S. PATENT DOCUMENTS

| | | | | |
|---|---|---|---|---|
| 3,446,213 | A * | 5/1969 | Goldman | A41C 3/10 450/39 |
| 3,503,404 | A * | 3/1970 | Evers | A41C 3/06 450/39 |
| 3,773,052 | A | 11/1973 | Belardinelli | |
| 3,934,593 | A * | 1/1976 | Mellinger | A41C 3/065 428/355 R |
| 4,343,313 | A * | 8/1982 | Le Jeune | A41C 3/065 450/39 |
| 5,904,607 | A | 5/1999 | Abadi | |
| 7,677,952 | B2 | 3/2010 | Wooley | |
| 8,152,593 | B2 | 4/2012 | Barton et al. | |
| 9,565,878 | B2 * | 2/2017 | Hernandez | A41C 3/065 |
| 2002/0022432 | A1 | 2/2002 | Magrone et al. | |
| 2010/0009598 | A1 | 1/2010 | Barton et al. | |
| 2011/0177756 | A1 | 7/2011 | Morgan et al. | |
| 2012/0028540 | A1 | 2/2012 | Schmell | |
| 2012/0266348 | A1 * | 10/2012 | Meginnis | A41B 17/00 2/69 |
| 2015/0044941 | A1 * | 2/2015 | Luxi | A41C 3/0007 450/41 |

OTHER PUBLICATIONS love-of-lingerie.com/shelf-bas.html, 2015 text—search result page.
Zenzendream.com/products/Sleeping-Beauty-Bust-Push-Up-Shaper/58—2015 text—search result page.
Tobeinstyle.com/bustline-cleavage-shaper-enhancer-pushup-breast-instant-lift-bra-shaping-posture.html, 2015 text—search result page.
Barenecessities.com/—2015 text—search result page.

* cited by examiner

CLEAVAGE ENHANCING UNDERGARMENT SYSTEM

CROSS REFERENCE TO RELATED APPLICATIONS

This application claims the benefit of U.S. Provisional Application No. 62/340,338, filed May 23, 2016, which is incorporated herein by reference.

FIELD OF THE INVENTION

The present invention relates to an undergarment system to be worn by women and particularly relates to such a system having an open front and an enhancing element that adjustably increases the cleavage of a woman wearing the undergarment.

DESCRIPTION OF THE PRIOR ART

Bras have been used to cover, support and enhance a woman's breasts for many years. Bras typically have over-the-shoulder straps, cups for each breast, a strap or straps around the back and a strap connecting the cups in the front.

Bras are typically worn under clothing and are not visible to others. Over the years, the bra has undergone many changes. For example, while the bra was at one time a method of concealment, it has more recently become a tool to enhance the shape lines of the wearer. This has been evidenced in recent years by the extreme popularity of cleavage enhancing bras. The trend in women's clothes has been toward more revealing clothes, creating a similar trend in bras to be smaller, thinner and are less obtrusive. For example, strapless bras are useful for women wearing clothing that reveals the upper part of the shoulders. Even so, presently available bras which are designed to enhance a wearer's cleavage are either not structured to be worn or unable to work effectively when worn under certain elegant, stylish garments which are strapless or which offer a lowcut plunging neckline or bare back look. The lowcut dresses with the plunging necklines which are sometimes worn by women must be worn braless and that reveals the area on the chest of a woman between the breasts. Typically this exposes a gap between the breasts of the wearer and does not provide cleavage or extra enhancement of actual breast size.

As such types of dresses and other garments have become extremely popular, there remains a great need in the art for bras or other type of undergarments that not only enhance the wearer's breast size and cleavage, but which further can effectively do so without the use of straps about the shoulders or the wearer's back or beneath the breasts of the wearer.

Several bras known in the art utilize various inserts and bindings to achieve the enhancement of the wearer's cleavage. However, many of these devices are uncomfortable to the wearer and further have resulted in surface irregularities such as one or more bumps or protrusions that are visible and highly noticeable even through the wearer's clothing or outer garments. Thus, there remains a need in the art for a bra that not only enhances the wearer's breast size and cleavage but further which is comfortable to wear and which will not cause any surface irregularities that would be visible through a wearer's clothing or other garments.

SUMMARY OF THE INVENTION

The present invention is directed toward a bra-like undergarment which enhances the breast size and cleavage of the wearer. The undergarment of the present invention, however, does not have any straps over the shoulder or around the back or between the breasts supporting portions of the garment. As a result, throughout the remaining part of this application, the breast size and cleavage enhancing undergarment of the present invention will be referred to as a "braette".

The present invention includes a frontless, backless and strapless braette adapted to provide enhanced breast size and cleavage of the breasts of a wearer and includes a first compression pad having an inner and outer surface, the inner surface being contoured to engage the outer surface of one breast of the wearer, a second compression pad having an inner and an outer surface, the inner surface being contoured to engage the outer surface of the other breast of the wearer and a force-generating member having first and second ends connected to said first and second compression pads, respectively, and extending downwardly, away from the breast of the wearer toward the abdomen of the wearer to push the breasts of the wearer toward each other to provide the enhanced breast size and cleavage.

DETAILED DESCRIPTION OF THE PREFERRED EMBODIMENTS

The braette of the present invention is a strapless, frontless, backless undergarment with no connecting facets in the front or back so that the wearer may wear any of the present elegant, stylish and very cool garments which are strapless, or utilize a low back or a plunging V-shape front that will expose a portion of the breasts of the wearer. The specific design of the braette of the present invention provides compression pads which push the breasts together and the appearance of lift to enhance the breast size and cleavage of the wearer and remains in place against the outer surfaces of the breasts of the wearer with absolutely no support material such as straps over the shoulders, between the breasts or the back of the wearer. The braette of the present invention is adjustable by the wearer to create the cleavage appearance that is desired to close the gap between the breasts without the look of a bra. To accomplish this, the breasts are pushed toward each other and this causes a loss of volume and width of the breasts. To overcome this, a pad of desired thickness can be attached to the outer surface of the compression pads to give fuller looking breasts. In the event that a backless look is not needed for the gown that is being worn, the wearer can attach a strap to the braette that wraps around the waist. Such straps may be of small discreet seamless material or, if desired, can be constructed of shapewear material to provide an hourglass look to the waist area while simultaneously providing the frontless strapless look.

Figure 1:
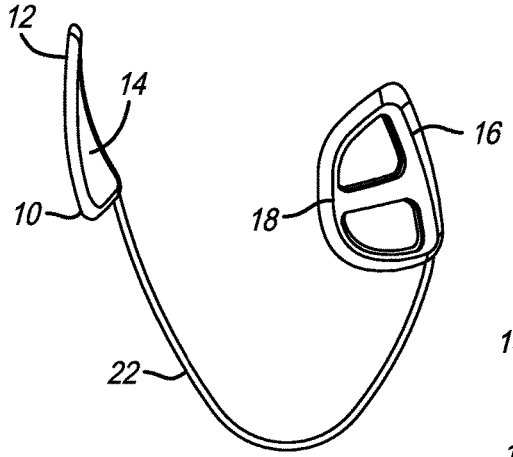
FIG. 1 is a perspective view of one embodiment of the braette of the present invention.
Figure 2:
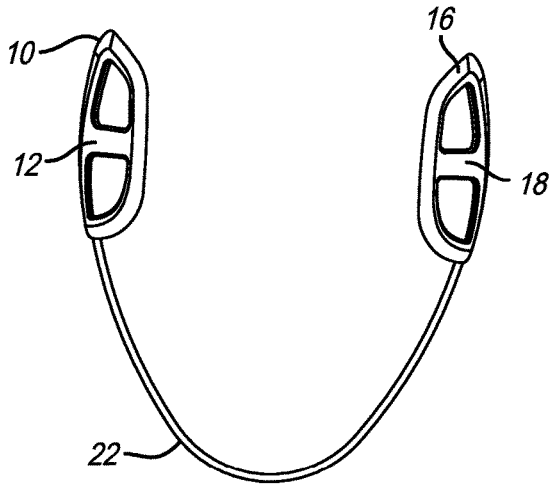
FIG. 2 is a front elevational view of the braette of FIG. 1.
Figure 3:
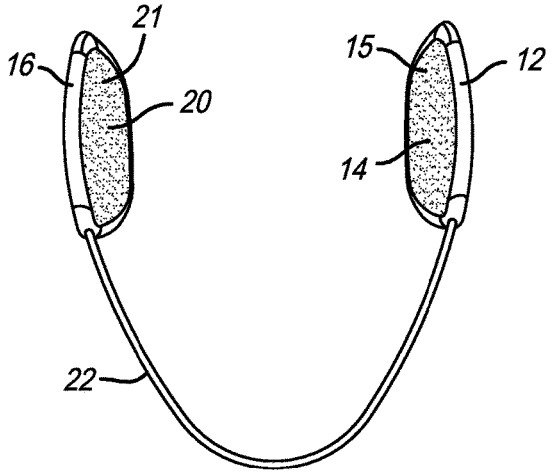
FIG. 3 is a rear elevational view of the braette of FIG. 1.

Referring now more particularly to FIGS. 1 through 3, there is illustrated a braette constructed in accordance with the principles of the present invention. As is therein shown, the braette includes a first compression pad 10 having an outer surface 12 and an inner surface 14. As is illustrated, the inner surface 14 is contoured in a manner to engage the outer surface of one breast of the wearer and in the manner illustrated in FIG. 1, the compression pad 10 would engage the outer surface of the right breast of the wearer. There is also provided the second compression pad 16 which likewise has an outer surface 18 and an inner surface 20 which is also contoured to engage the outer surface of the other breast of the wearer, in a configuration as shown in FIG. 1 which would be the left breast of the wearer. Depending on the material and construction of the compression pads 10 and 16, the inner surfaces 14 and 20 may have an anti-skid coating material applied thereto as illustrated at 15 and 21. This would reduce or eliminate any downward slippage of the compression pads due to gravity and agitation.

A force-generating member 22 is connected to the compression pads 10 and 16. The preferred manner in which the compression pads are connected to the first and second ends (not shown in FIGS. 1 through 3) of the force-generating member is by in situ injection molding of the compression pads 10 and 16 around the ends of the force-generating member 22. The force-generating member 22 is preferably a beam or rod constructed of metal in this embodiment and more preferably that metal is steel and can be cold rolled steel or spring steel, or if desired, the steel may be heat treated in manners well known to the prior art. The function of the force-generating member 22 is to apply an inwardly directed force to the compression pads 10 and 16 to cause them to push the breasts together and also to provide the appearance of lift to the breasts to enhance the breast size and cleavage. It is therefore an important feature of the present invention that the metal beam or rod retain its resilience so it can be repeatedly used. Also, the wearer may adjust the amount of force to be applied to the breasts by bending the beam or rod. In utilization of the structure as illustrated in FIGS. 1 through 3, the wearer would separate the compression pads 10 and 16 by pulling them outward and would then apply the inner surfaces 14 and 20 of the compression pads to the outer surface of the wearer's breasts and release the compression pads 12 and 16. At this point, the metal force-generating member would urge the compression pads toward each other and apply a force, typically between 1 and 5 lbs., directed inwardly against the outer surfaces of the breasts of the wearer, causing the breasts to be pushed together to enhance the cleavage and to provide the appearance of lift to the breasts of the wearer to enhance the breast size.

Figure 4:
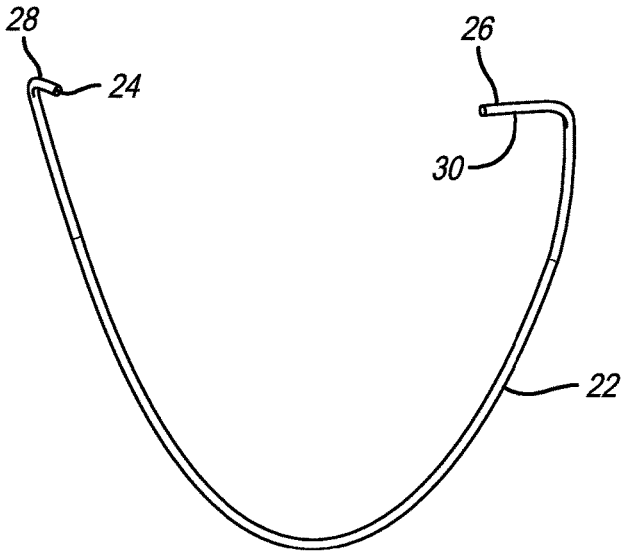
FIG. 4 is a perspective view of the force-generating member of the braette of FIG. 1.

Referring now more specifically to FIG. 4, the force-generating member 22 is shown in its entirety. As is therein shown, the force-generating member 22 has a first end 24 and a second end 26.

The first and second ends 24 and 26 are found on the terminal portions 28 and 30, respectively, of the metal beam 22. The terminal portions 28 and 30, as illustrated, are bent at substantially right angles to the longitudinal axis of the metal beam 22. If desired, the ends of the beam 22 may be bent again to be directed back toward the main part of the beam. Such configuration is then totally encapsulated within the molded plastic compression pads 10 and 16. By being bent in this manner, the metal beam 22 is securely retained within the compression pads 10 and 16 at all times.

Figure 5:
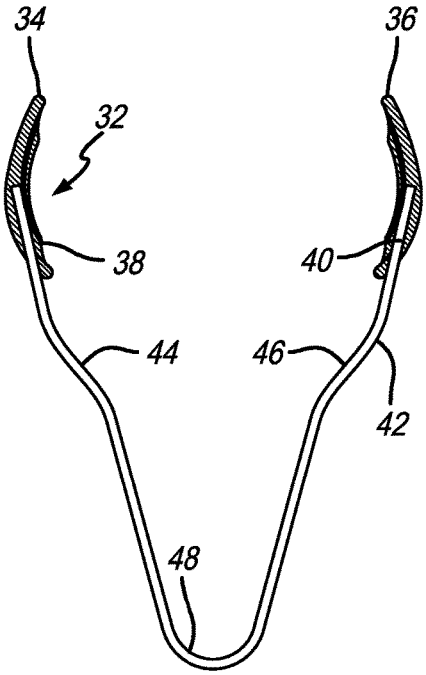
FIG. 5 is a partially cross-sectional view of a braette having a different embodiment of a force-generating member.

Referring now more particularly to FIG. 5, there is shown an alternative embodiment of a braette 32 constructed in accordance with the principles of the present invention. As is therein shown, the compression pads 34 and 36 which are shown partially in cross section are molded plastic members which surround and encompass the ends 38 and 40, respectively, of the force-generating metal beam 42 constructed of material as above described. As is illustrated, the beam 42 is curved slightly inwardly as shown at 44 and 46 below the compression pads 34 and 36, respectively. After this slight inward curving, the metal beam 42 then extends downwardly a further distance than that shown in the braette of FIGS. 1 through 3 and is illustrated at 48. This construction would be utilized in a stylish garment which has a severely plunging neckline that would extend downwardly well below the breasts of the wearer.

Figure 6A:
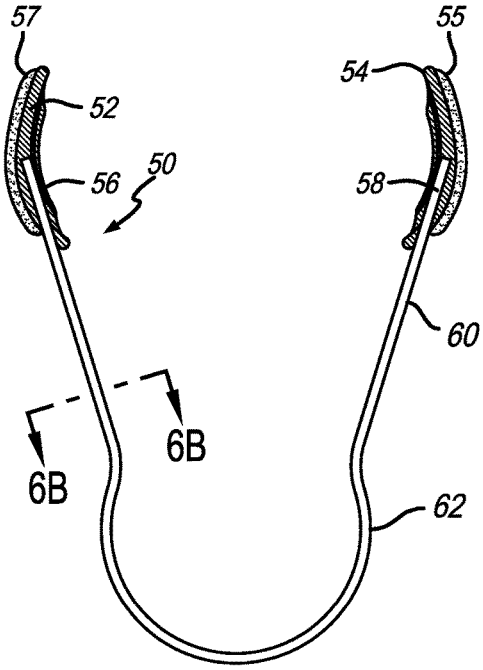
FIG. 6A is another alternative embodiment in a partial cross section of a different force-enhancing member of the braette of the present invention.
Figure 6B:
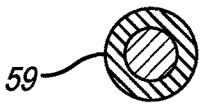
FIG. 6B is a cross-sectional view of the force-enhancing member taken about the lines B-B of FIG. 6A.

Referring now to FIG. 6A, there is shown yet another alternative embodiment of a braette 50 constructed in accordance with the principles of the present invention. As is therein shown, the compression pads 52 and 54 which are shown in partial cross section are molded plastic members which surround and encompass the ends 56 and 58, respectively, of the metal force-generating beam 60. The force-generating beam 60 is constructed of metal as above described. As is illustrated in FIG. 6, the metal beam 60 extends relatively straight and downwardly from the compression pads 52 and 54 and then toward the abdomen of the wearer, the metal beam 60 is then bent outwardly to form a semicircle as shown at 62 which then causes the beam 60 to be moved outwardly away from the center portion of the abdomen. A braette as shown at 50 in FIG. 6 would then be worn with an elegant stylish garment that not only has a plunging neckline, but is opened in the front to expose a greater portion of the front of the wearer beneath the breasts. The metal beam 60 may have a coating 59 as shown in FIG. 6B of plastic or a rubber material to make the metal beam more comfortable to wear.

It should be recognized by those skilled in the art that various configurations of the force-generating beam may be utilized without departing from the scope of the invention as defined by the claims herein. In each instance, a force-generating member would be configured to provide a braette that may be worn with different configurations of elegant stylish garments that women would desire to wear at various occasions.

Figure 7:
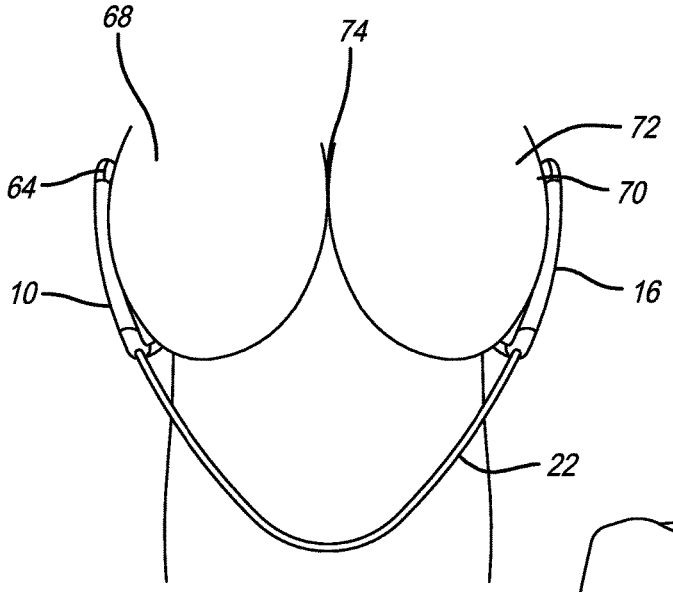
FIG. 7 is a front elevational view showing the braette of FIG. 1 in place on the breasts of a wearer.

Referring now more particularly to FIG. 7, the braette as illustrated in FIGS. 1 through 3 is shown in place on the breasts of a wearer. As is shown therein, the compression pad 10 is in place on the outside surface 64 of the right breast 68 of the wearer. The compression pad 16 is clearly shown in engagement with the outside surface 70 of the left breast of the wearer. The force-generating metal beam 22 is applying an inwardly directed force to the breasts 68 and 72 of the wearer, thus pushing them toward each other and the appearance of lift to enhance the cleavage 74 as clearly illustrated in FIG. 7 and to enhance the breast size.

Figure 8:
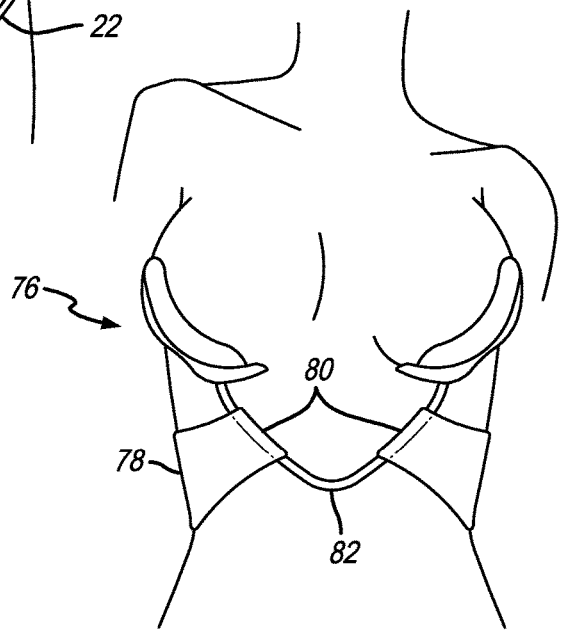
FIG. 8 is an alternative embodiment illustrating the utilization of a torso-engaging member attached to the braette of FIG. 1.
Figure 9:
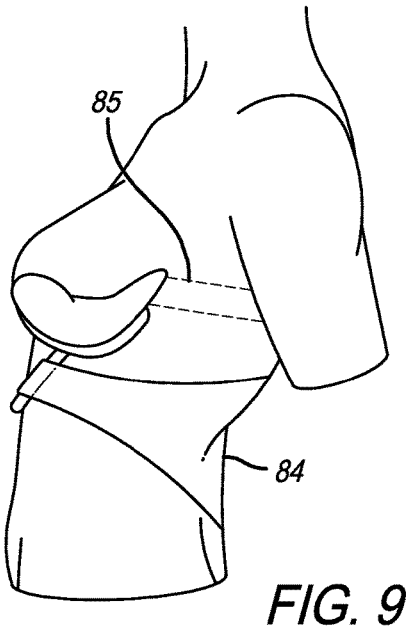
FIG. 9 is a side elevational view of the structure illustrated in FIG. 8.

Referring now more particularly to FIGS. 8 and 9, there is illustrated a braette 76 in place on a wearer. This braette may be of the type shown in FIGS. 1 through 3 or additionally others as illustrated and described herein. The feature as shown at FIGS. 8 and 9 is that in some instances a wearer of a braette constructed in accordance with the principles of the present invention may also desire to include a shapewear type garment of a type shown at 78 which is attached to the force-generating member of the braette. As is illustrated, the garment 78 would be attached as shown at 80 to the downward extending portions of the force-generating member 82, for example, by way of hook and loop fasteners which would go around the force-generating member and be attachable to hold the garment 78 in place. Utilization of a garment of this type secured to the force-generating beam does not interfere with the force-generating function of the beam. As shown more particularly in FIG. 9, the garment 78 would extend along the back as shown at 84 and through its construction would provide a desired hourglass shape to the midsection of the wearer. It should be noted that even with this garment in place, the wearer would still be capable of wearing an elegant and stylish garment which is strapless at the shoulders and frontless as above described. As shown by the dash line 85, a single strap may be attached to the force-generating member instead of the shapewear style member 84.

Figure 10:
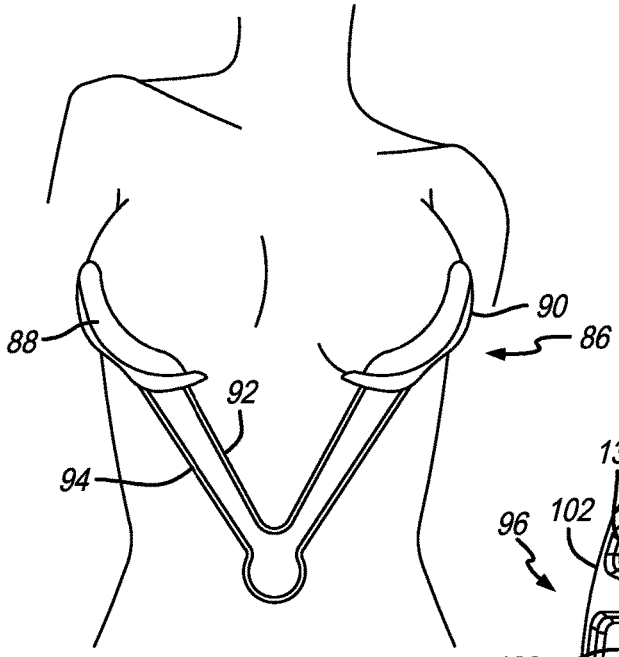
FIG. 10 is yet another alternative embodiment illustrating a different force-generating member for a braette similar to that of FIG. 1.

Referring now more particularly to FIG. 10, there is illustrated yet an additional embodiment of a braette constructed in accordance with the principles of the present invention. The braette 86 as shown in FIG. 10 includes the compression pads 88 and 90 constructed as above described. The major difference in the construction of the braette 86 as shown in FIG. 10 is that there are multiple force-generating members as shown at 92 and 94 as opposed to a single force-generating member as described and illustrated herein above.

Figure 11:
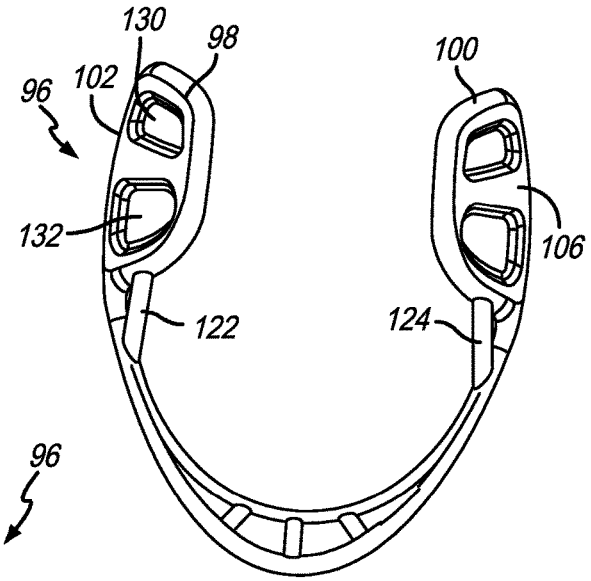
FIG. 11 is a front elevational view of a further embodiment of a braette which is constructed as a unitary injection molded plastic structure.
Figure 12:
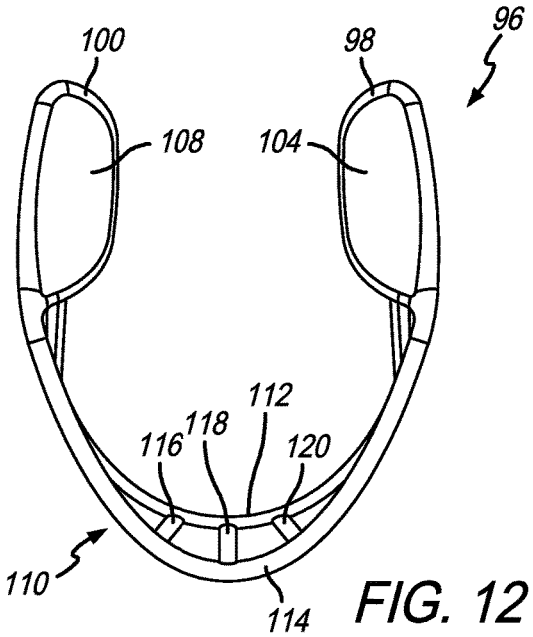
FIG. 12 is a rear elevation view of the structure of FIG. 11.

Referring now more particularly to FIGS. 11 and 12, there is illustrated yet another alternative embodiment of the braette constructed in accordance with the principles of the present invention. The braette as shown in FIGS. 11 and 12 is a system which is formed as a unitary injection molded plastic structure as is shown in FIGS. 11 and 12. The braette 96 includes a compression pad 98 and a compression pad 100. The compression pad 98 includes an outer surface 102 and an inner surface 104. The inner surface 104 is contoured to engage the outer surface of one breast of the wearer. The compression pad 100 has an outer surface 106 and an inner surface 108. Again, the inner surface 108 is contoured to engage the outer surface of the other breast of the wearer. Interconnected between the compression pads 98 and 100 is a force-generating member 110 which, as above indicated, is constructed as a unitary portion of the braette 96. The force-generating member 110 includes an upper beam 112 and a lower beam 114 which are interconnected by a plurality of bars as shown at 116, 118 and 120 which provides additional strength to the force-generating member 110. In addition, to provide additional strength to the system as shown at 96, there are additional strengthening bars 122 and 124 which are connected between the force-generating member 110 and the compression pads 98 and 100, respectively.

Figure 13:
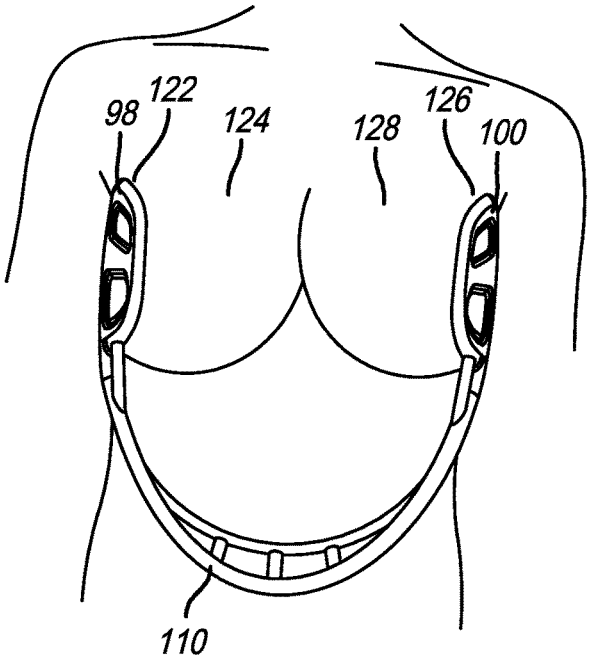
FIG. 13 is a front elevational view showing the braette of FIG. 11 in place on the breasts of a wearer.

Referring now more particularly to FIG. 13, the braette as shown at 96 in FIGS. 11 and 12 is illustrated in place on a wearer. As is illustrated, the compression pad 98 is in position on the outer surface 122 of the right breast 124 of the wearer. The compression pad 100 is illustrated as being applied to the outer surface 126 of the left breast 128 of the wearer. As is also clearly illustrated, the force-generating member 110 extends downwardly below the breasts of the wearer and down toward the abdomen.

Figure 14:
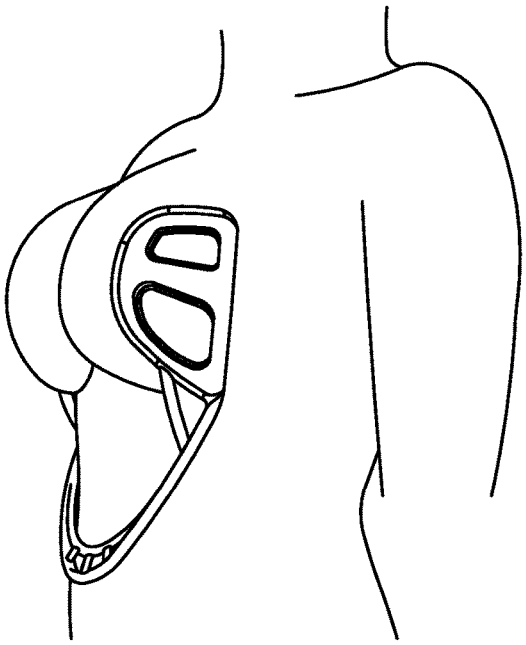
FIG. 14 is a side elevation of the braette in place as shown in FIG. 13.

Referring now to FIG. 14, the braette 96 is shown from a side view in place on the breasts of the wearer and as shown, the force-generating member extends downwardly from the breasts toward the abdomen of the wearer. It should be understood by those skilled in the art that the force-generating member can take various configurations other than that illustrated in FIGS. 11 through 14 and may extend further down if such is desired.

As is also illustrated in FIGS. 11 through 14, the compression pads 98 and 100 may be cored out as illustrated at 130 and 132 in FIG. 11 to reduce the weight and to also minimize the utilization of the plastic material forming the braette. It is also to be understood by those skilled in the art that the unitary braette as shown in FIGS. 11 through 14 may be constructed from various types of plastic material which will provide the desired force-generating mechanism as above described. At the present time, in accordance with one embodiment of the invention, the unitary injection molded structure as shown in FIGS. 11 through 14 will be injection molded from a thermoplastic polyblend of acrylonitrile butadiene styrene (ABS) and polycarbonate (PC) and, if necessary to provide the desired strength, the polyblend may be filled with fiberglass. It should also be understood that the compression pads as shown in the braettes utilizing the metal force-generating beam may also be constructed of the thermoplastic polyblend of the same type.

Further enhancements to the Braette structure can include a simple strap around the back which connects the two compression pads and provides a seating force that pulls the braette back into the users body thereby minimizing visibility of the braette through clothing. This enhancement maintains the open front aspect of the braette. Another very useful enhancement which improves the lifting action upon the breast of the user works as follows. A loop of fabric which connects at the top of the Braette compression pad and runs around the shoulder, that is on the same side as the attached compression pad, of the user. One such loop on each side of the user can provide an upward lifting force on the braette which will enhance the lifting aspect of the Braette system while maintaining the frontless and backless advantages of the braette.

There has thus been disclosed various embodiments of a braette which includes compression pads interconnected with a force-generating member to apply pressure to the outer surface of the breasts of the wearer to push them together to enhance the cleavage and constructed in such a manner that the braette is capable of being retained on the breasts of the wearer without the support of any kind by way of straps or the like.

What is claimed is:

1. A frontless, backless and strapless braette configured to expose front and back portions of the wearer's body when worn by the wearer and adapted to provide enhanced cleavage of a wearer's first and second breasts each breast having an outer surface, comprising:

a first compression pad having an inner and outer surface, the inner surface being contoured to engage the outer surface of the first breast of the wearer;

an antiskid material applied to said inner surface of said first compression pad to prevent downward slipping of said first compression pad;

a second compression pad having an inner and outer surface, the inner surface being contoured to engage the outer surface of the second breast of the wearer;

an antiskid material applied to said inner surface of said second compression pad to prevent downward slipping of said second compression pad; and a force-generating member having first and second ends each connected to said first and second compression pads, respectively, with no support material between the breasts of the wearer, said force generating member extending downwardly away from the breasts of the wearer toward the abdomen of the wearer to push the breasts of the wearer toward each other to provide enhanced cleavage whereby a greater portion of the front of the body of the wearer beneath the breasts is exposed so that the wearer can wear a stylish garment having a plunging neckline.

2. A frontless, backless and strapless braette as defined in claim 1 wherein said force-generating member is a beam formed from metal.

3. A frontless, backless and strapless braette as defined in claim 2 which further includes a pad secured to the outer surface of each compression pad and is configured to fill out each side of a wearer's breasts.

4. A frontless, backless and strapless braette as defined in claim 2 wherein the compression pads are formed from injection molded plastic material.

5. A frontless, backless and strapless braette as defined in claim 2 which further includes a coating on said metal force-generating member.

6. A frontless, backless and strapless braette as defined in claim 4 wherein the first and second ends of said metal force-generating member are connected to said first and second compression pads by in situ injection molding of said compression pads.

7. A frontless, backless and strapless braette as defined in claim 1 wherein said first and second compression pads and said force-generating member are formed as a unitary injection molded plastic structure.

8. A frontless, backless and strapless braette as defined in claim 1 wherein the force-generating member produces two to five pounds of force on each compression pad against the outer surface of the first and second breast to secure the braette to a wearer without straps or other support devices.

9. A frontless, backless and strapless braette as defined in claim 7 which further includes a pad secured to the outer surface of each compression pad and is configured to fill out each side of a wearer's breasts.

10. A frontless, backless and strapless braette as defined in claim 1 which further includes a shapewear member secured to said force-generating member and extending around the back of the wearer configured to produce an hourglass appearance to a wearer's body.

11. A frontless, backless and strapless braette as defined in claim 1 which further includes a single strap member having first and second ends with the first end connected to said force generating member adjacent the first compression pad and the second end connected to said force generating member adjacent said second compression pad and extending around the back of the wearer.

* * * * *